US008413288B2

(12) United States Patent
Scott, Sr. et al.

(10) Patent No.: US 8,413,288 B2
(45) Date of Patent: Apr. 9, 2013

(54) PAINT ROLLER COVER SUPPORTS WITH FRICTION RINGS

(75) Inventors: John L. Scott, Sr., Wooster, OH (US); Michael L. Zimmerman, Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 625 days.

(21) Appl. No.: 12/627,770

(22) Filed: Nov. 30, 2009

(65) Prior Publication Data

US 2010/0139559 A1 Jun. 10, 2010

Related U.S. Application Data

(60) Provisional application No. 61/120,733, filed on Dec. 8, 2008.

(51) Int. Cl.
*B05C 17/02* (2006.01)

(52) U.S. Cl.
USPC ..... 15/230.11; 492/19

(58) Field of Classification Search ..... 15/230.11; 492/13, 19, 21
See application file for complete search history.

(56) References Cited

U.S. PATENT DOCUMENTS

| | | | | |
|---|---|---|---|---|
| 2,142,873 | A * | 1/1939 | Krause | 451/507 |
| 2,647,299 | A | 8/1953 | Thomas | |
| 2,987,746 | A | 6/1961 | Davis et al. | |
| 3,060,555 | A | 10/1962 | Kirshenbaum et al. | |
| 3,447,184 | A | 6/1969 | McGinley | |
| 4,105,445 | A * | 8/1978 | Wilson et al. | 430/56 |
| 4,316,301 | A | 2/1982 | Smith et al. | |
| 4,742,597 | A * | 5/1988 | LaFlamme | 15/244.2 |
| 4,897,893 | A * | 2/1990 | Barker | 15/230.11 |
| 6,203,648 | B1 | 3/2001 | Barton et al. | |
| 2006/0123578 | A1 | 6/2006 | Rickstrew | |
| 2007/0012549 | A1 | 1/2007 | Kanaris | |

FOREIGN PATENT DOCUMENTS

| | | |
|---|---|---|
| DE | 922693 | 1/1955 |
| WO | WO 2008/053195 A1 | 5/2008 |

OTHER PUBLICATIONS

PCT/US2009/066546—International Search Report and Written Opinion of the International Searching Authority mailed Feb. 5, 2010 (enclosed).

* cited by examiner

*Primary Examiner* — Randall Chin
(74) *Attorney, Agent, or Firm* — Renner, Otto, Boisselle & Sklar, LLP

(57) ABSTRACT

Paint roller cover supports include axially spaced substantially rigid portions for supporting roller covers thereon and elastomeric material interposed between the substantially rigid portions that is compressed during axial movement of the substantially rigid portions toward one another to cause the elastomeric material to expand radially outward into frictional engagement with the inner diameter of a surrounding roller cover. In one form of the invention, the substantially rigid portions are comprised of a plurality of substantially rigid plastic rings and the elastomeric material comprises elastomeric rings interposed between the substantially rigid rings. In another form of the invention, the substantially rigid portions are formed by a helix of substantially rigid plastic material having a helical groove along the length of the helix containing the elastomeric material.

17 Claims, 6 Drawing Sheets

PAINT ROLLER COVER SUPPORTS WITH FRICTION RINGS

CROSS-REFERENCE TO RELATED APPLICATIONS

This application claims the benefit of U.S. Provisional Application Ser. No. 61/120,733, filed Dec. 8, 2008, the entire disclosure of which is incorporated herein by reference.

FIELD OF THE INVENTION

This invention relates generally to rotatable supports for paint roller covers that include elastomeric portions that, when axially compressed, expand radially outward into frictional engagement with the inner diameter of the roller covers for securely retaining the roller covers on the supports.

BACKGROUND OF THE INVENTION

Paint roller cover supports are typically rotatably mounted on a shaft portion of a roller frame, and are adapted to receive a cylindrical roller cover that is designed to hold paint or other coating material (hereinafter collectively "paint") for coating a variety of surfaces including but not limited to walls, ceilings, floors, decking and fencing of various compositions and textures.

It is generally known to provide paint roller cover supports that allow for relatively easy insertion and removal of roller covers therefrom and that also fairly well retain the roller covers on the roller cover supports during use as long as the roller covers have a substantially rigid core.

However, there is an ongoing need for roller cover supports that also provide sufficient gripping force to retain roller covers in place on the roller cover supports without slippage during use regardless of whether the roller covers have substantially rigid cores or whether the roller covers are coreless. For example, in some cases the roller cover cores may not be substantially rigid or the roller covers may simply be attached to a substrate or backing material that provides sufficient stability to the roller covers without the need for a core.

SUMMARY OF THE INVENTION

The paint roller cover supports of the present invention include substantially rigid portions for supporting roller covers on a shaft portion of a roller frame and elastomeric portions that are axially compressible to cause the elastomeric portions to expand radially outward into frictional engagement with the inner diameter of the roller covers to retain the roller covers on the supports regardless of slight variations in the inner diameter of the roller covers, and regardless of whether the roller covers have a substantially rigid core or the roller covers are coreless.

In accordance with one aspect of the invention, the substantially rigid portions are ring portions rotatably mounted on the shaft portion of a roller frame, and the elastomeric portions are interposed between the substantially rigid ring portions and are compressed thereby during axial movement of the substantially rigid ring portions toward one another to cause the elastomeric portions to expand radially outward into frictional engagement with the inner diameter of surrounding roller covers for securely retaining the roller covers on the supports.

In accordance with another aspect of the invention, the substantially rigid ring portions are comprised of a plurality of axially spaced substantially rigid plastic rings each having an outer diameter slightly less than the inner diameter of the roller covers to be supported thereby, and the elastomeric portions comprise elastomeric rings interposed between the substantially rigid rings.

In accordance with another aspect of the invention, adjacent ends of the substantially rigid rings and elastomeric rings are mechanically connected, adhesively bonded, or plastic welded together.

In accordance with another aspect of the invention, the elastomeric rings are over molded between the substantially rigid rings.

In accordance with another aspect of the invention, the substantially rigid portions are formed in a helix having a helical groove containing the elastomeric portions.

In accordance with another aspect of the invention, the elastomeric portions are over molded in the helical groove of the helix.

In accordance with another aspect of the invention, the elastomeric portions are mechanically connected, adhesively bonded or plastic welded to the oppositely facing walls of the helical groove.

In accordance with another aspect of the invention, opposite end portions of the substantially rigid portions are respectively attached to inboard and outboard end caps rotatably mounted on the shaft portion of a roller frame.

In accordance with another aspect of the invention, the outboard end cap is axially movable toward and away from the inboard end cap for causing axial inward and outward movement of the substantially rigid ring portions toward and away from one another.

In accordance with another aspect of the invention, a receiver extends axially outwardly from the inboard end cap along the shaft portion radially inwardly of the substantially rigid ring portions and elastomeric portions, and a retainer extends axially inwardly from the outboard end cap along the shaft portion radially inwardly of the substantially rigid ring portions and elastomeric portions.

In accordance with another aspect of the invention, the receiver and retainer have overlapping end portions, one of which has axially spaced bumps or ribs on opposite sides, and the other of which has teeth on opposite sides that ride in and out of the bumps or ribs during axial movement of the outboard end cap toward and away from the inboard end cap for releasably retaining the outboard end cap in different axial positions relative to the inboard end cap.

In accordance with another aspect of the invention, the retainer end portion is axially slidably received in the receiver end portion, the axially spaced bumps or ribs are on opposite radial outer sides of the retainer, and the teeth are on opposite radial inner sides of the receiver.

In accordance with another aspect of the invention, the retainer and receiver are keyed together as a unit for rotation on the shaft portion.

These and other objects, advantages, features and aspects of the present invention will become apparent as the following description proceeds.

To the accomplishment of the foregoing and related ends, the invention, then, comprises the features hereinafter more fully described and particularly pointed out in the claims, the following description and annexed drawings setting forth in detail certain illustrative embodiments of the invention, these being indicative, however, of but several of the various ways in which the principles of the invention may be employed.

DETAILED DESCRIPTION OF THE INVENTION

Figure 1:
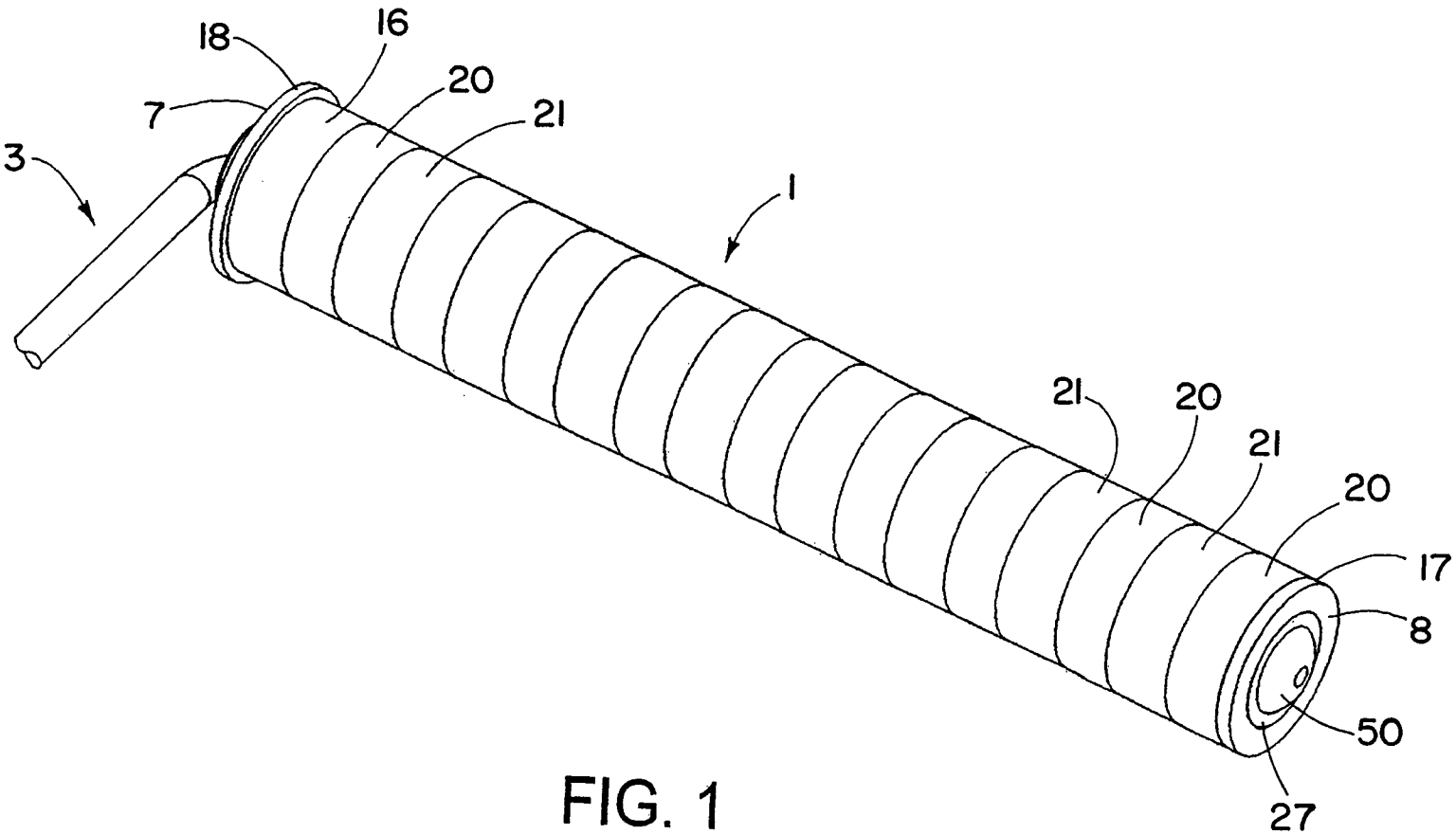
FIG. 1 is a schematic perspective view of one form of roller cover support of the present invention showing the elastomeric feature in its non-compressed condition to allow for easy insertion of a roller cover onto the support.
Figure 2:
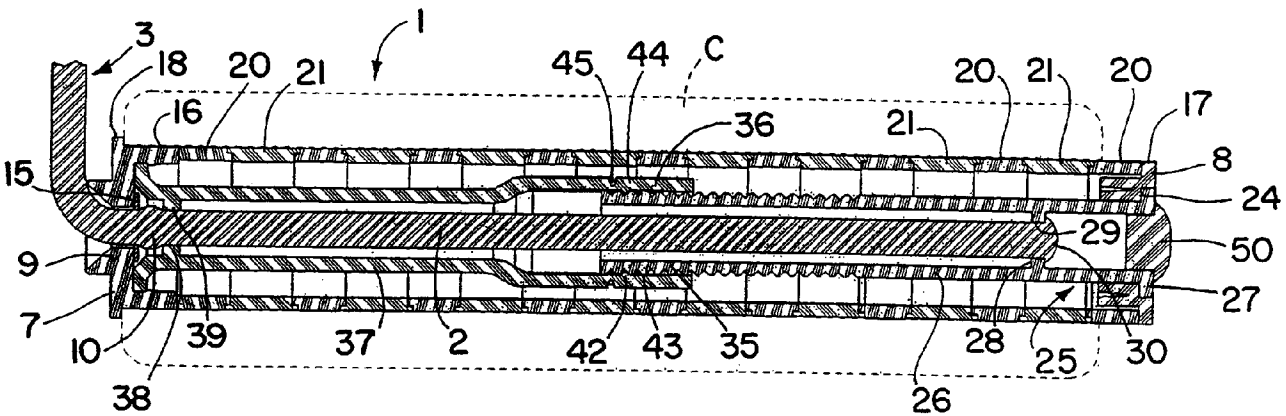
FIG. 2 is a longitudinal section through the roller cover support of FIG. 1 showing a roller cover slidably inserted onto the support.
Figure 3:
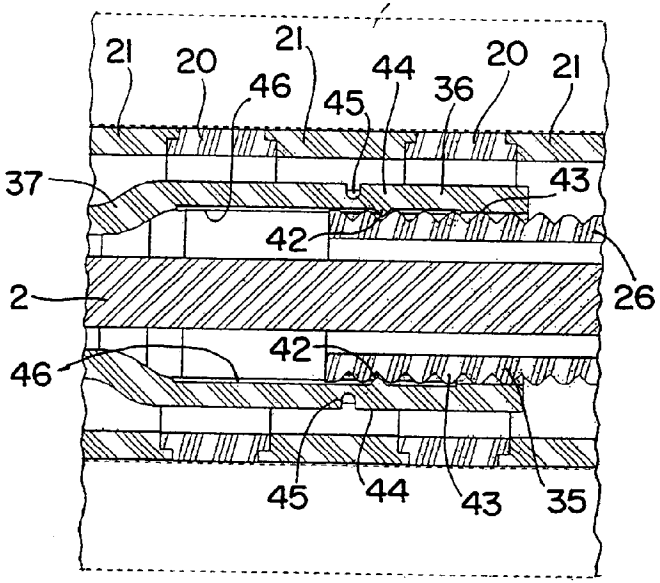
FIG. 3 is an enlarged fragmentary longitudinal section of a portion of the roller cover support of FIG. 2 showing the elastomeric feature in the non-compressed condition.

Referring now in detail to the drawings, and initially to FIGS. 1-3, there is shown one form of paint roller cover support 1 of the present invention mounted on a shaft portion 2 of a paint roller frame 3 (only a portion of which is shown). Roller frame 3 may be made from heavy gauge wire or rod bent to shape to provide the shaft portion 2 which may have a right angle bend adjacent the inboard end of the shaft for connection to the handle portion.

Roller cover support 1 includes axially spaced inboard and outboard end caps 7 and 8 that may be molded out of any suitable plastic material. Inboard end cap 7 is shown rotatably supported adjacent the inboard end of shaft portion 2 by an inboard bearing 9. The inboard bearing may be retained against axial movement along the shaft portion as by forming stake-out portions 10 on the shaft portion in close proximity to the axial outward facing side of the inboard bearing and associated end cap. A washer 15 may be disposed between the stake-outs 10 and inboard bearing 9 to facilitate rotation of the inboard end cap on the shaft portion.

Both the inboard and outboard end caps include substantially rigid cylindrical outer wall portions 16 and 17 each having an outer diameter slightly less than the inner diameter of the roller covers to be supported thereby. At the axial innermost end of the cylindrical outer wall portion 16 of inboard end cap 7 is an annular stop flange or shoulder 18 for locating a roller cover C on the support when the inboard end of the roller cover is brought into engagement with the shoulder as schematically shown in FIG. 2.

Interposed between the inboard and outboard end caps 7 and 8 are a plurality of axially spaced substantially rigid cylindrical plastic rings 20. Each ring 20 desirably has an outer diameter slightly less than the inner diameter of the roller covers to be supported thereby. Interposed between the substantially rigid rings 20 are rings 21 made of a suitable elastomeric material. Adjacent ends of the respective rings 20 and 21 may be over molded, mechanically connected, adhesively bonded, or plastic welded to grooved edges therebetween. Likewise, the axial innermost and outermost substantially rigid rings 20 may be over molded, mechanically connected, adhesively bonded, or plastic welded to grooved edges of the adjacent ends of the inboard and outboard end caps.

Outboard end cap 8 may be supported on shaft portion 2 for limited axial movement toward and away from inboard end cap 7 as by attaching the outboard end cap to a compressor 25 that includes a tubular retainer 26 extending axially inwardly along the shaft portion through the open center of the substantially rigid and elastomeric rings 20 and 21. A radial flange 27 on the outer end of retainer 26 may be received in a counterbore 24 in the outboard end cap and the two parts may be plastic welded and/or press fitted together.

Retainer 26 is axially slidably supported on shaft portion 2 as by providing a web or flange 28 on the inner wall of the retainer having an opening 29 therethrough of a diameter slightly greater than the diameter of the shaft portion. Axial outward movement of the outboard end cap may be limited as by engagement of the flange 28 on the retainer with an upended flange 30 on the outboard end of the shaft as schematically shown in FIG. 2.

An axial inner end portion 35 of retainer 26 is axially slidably received in an axial outer end portion 36 of a tubular receiver 37 that may be fixedly attached at its axial inner end to inboard end cap 7 as by providing a snap connection therebetween (see FIG. 2). Receiver 37 extends axially outwardly along shaft portion 2 through the open center of the surrounding substantially rigid and elastomeric rings 20 and 21, and may be supported in radial spaced relation from the shaft portion by a web or flange 38 on the inner wall of the receiver having an opening 39 therethrough of a diameter slightly greater than the diameter of the shaft portion.

Figure 3A:
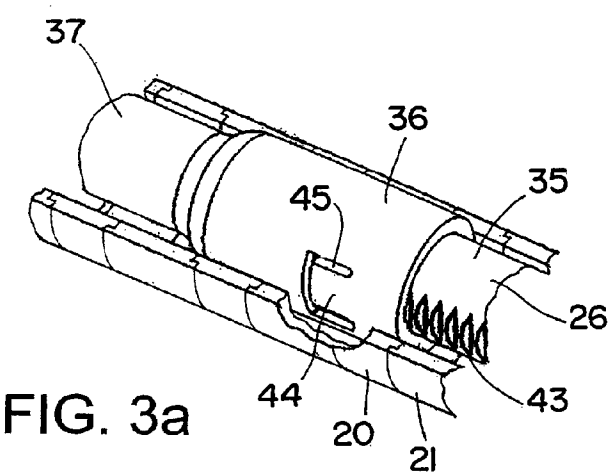
FIG. 3*a* is a fragmentary perspective view, partly in section, of the roller cover support portion of FIG. 3.

On opposite inner sides of receiver end portion 36 are individual radially inwardly extending teeth 42 that ride in and out of a plurality of axially spaced bumps or ribs 43 on opposite outer sides of retainer end portion 35 (see FIGS. 2 and 3) during axial movement of retainer 26 and associated outboard end cap 8 relative to the inboard end cap to releasably retain the outboard end cap in a desired position relative to the inboard end cap. Movement of the teeth in and out of the bumps or ribs on the retainer is due to flexing of the wall portions 44 of the receiver on which the teeth are formed. These wall portions may be made flexible by providing slots 45 extending partially or completely through the wall portions partway around the teeth as schematically shown in FIG. 3*a*. Bumps or ribs 43 are desirably on opposite radial outer sides of retainer end portion 35 for receipt in axially extending slots 46 in the inner wall of the receiver end portion 36 (see FIG. 3) to key the retainer and receiver together for rotation as a unit on the shaft portion. Alternatively the axial outer end portion of receiver 37 may be received in the axial inner end of retainer 26 and the bumps or ribs 43 may be provided on the opposite outer sides of the receiver and the teeth 42 may be provided on the opposite inner sides of the receiver and the teeth 42 may be provided on the opposite inner sides of the retainer if desired.

When the retainer 26 and associated outboard end cap 8 are in the fully extended position shown in FIG. 2, no compressive force is being applied to the elastomeric rings 21. In the non-compressed state, the outer diameter of the elastomeric rings is slightly less than the inner diameter of the roller covers to be supported thereby as schematically shown in FIGS. 2 and 3. This makes it very easy to slide the roller cover C onto the roller cover support 1 and up against the stop shoulder 18 on the inboard end cap 7 as shown in FIG. 2. Once the roller cover is inserted all the way onto the support, the retainer 26 and associated outboard end cap 8 may be pushed axially inwardly relative to the inboard end cap 7. Outboard end cap 8 and associated plug 50 in the outer end of retainer 26 provide a convenient surface for the user to push against to move the outboard end cap from the extended position shown in FIG. 2 to the retracted position shown in FIG. 4.

Figure 4:
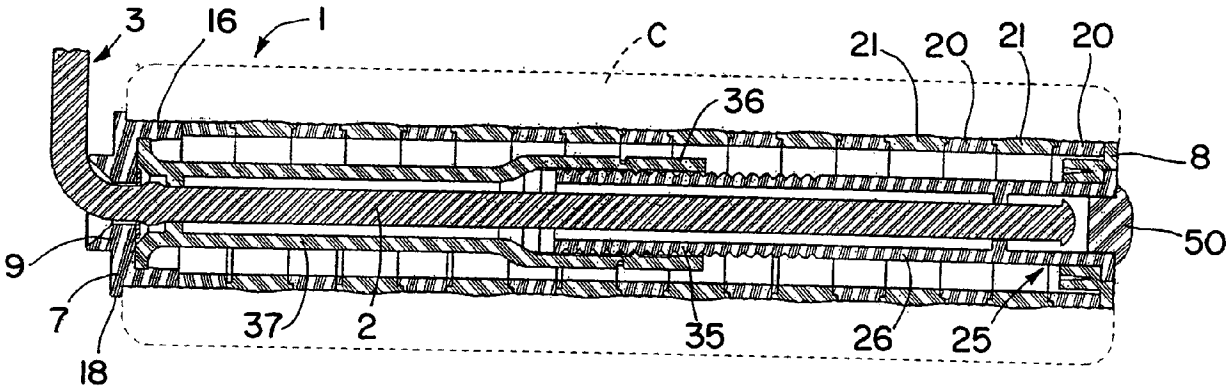
FIG. 4 is a longitudinal section through the roller cover support similar to FIG. 2 but showing the elastomeric feature in the compressed condition.
Figure 5:
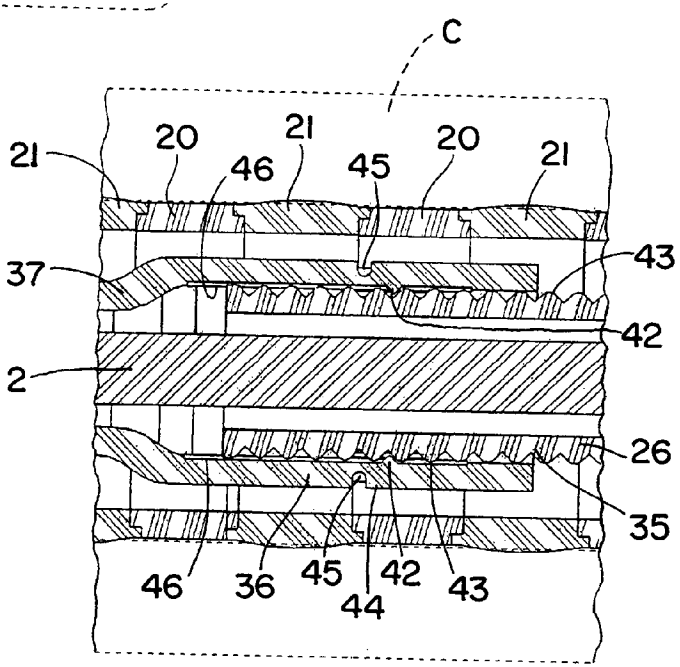
FIG. 5 is an enlarged fragmentary longitudinal section of a portion of the roller cover support of FIG. 4 showing the elastomeric feature in the compressed condition.

During such axial inward movement of the outboard end cap and associated retainer relative to the inboard end cap, the elastomeric rings 21 are compressed between the substantially rigid rings 20, thereby causing the elastomeric rings to expand radially outwardly into frictional engagement with the inner diameter of the surrounding roller cover as schematically shown in FIGS. 4 and 5. Such elastomeric rings 21 will be releasably retained in the desired expanded condition by engagement of the receiver teeth 42 with the retainer bumps or ribs 43 as schematically shown in FIG. 5. When the retainer 26 and associated outboard end cap 8 are pushed substantially all the way in, the outermost end of the outboard end cap will be substantially even with the outboard end of the roller cover as schematically shown in FIG. 4.

To release the roller cover C from the roller cover support 1 is easily accomplished as by rapping the right angle portion of the roller handle 3 adjacent the roller cover support against the edge of a bucket (with the roller cover support and surrounding roller cover extending into the bucket) to cause the retainer 26 and associated outboard end cap 8 to move axially away from the inboard end cap, allowing the elastomeric rings 21 to contract thus freeing the roller cover from the support.

FIGS. 6-10 show another form of roller cover support 60 of the present invention which is substantially the same as the roller cover support 1 shown in FIGS. 1-5. Accordingly, the same reference numerals followed by a prime symbol (') are used to designate like parts.

The main difference between the two embodiments is that the substantially rigid ring portions of the roller cover support 60 of FIGS. 6-10 are formed by a continuous helix 61 of substantially rigid plastic material having a helical groove 62 along the length of the helix, and the elastomeric portions are formed by a continuous length of elastomeric material 63 that may be over molded, mechanically connected, adhesively bonded, or plastic welded to grooved edges of the oppositely facing walls of the helical groove. Opposite ends 64 and 65 of the helix 61 may be closed and over molded, mechanically connected, adhesively bonded, or plastic welded to grooved edges of the respective end caps 7' and 8'.

Figure 6:
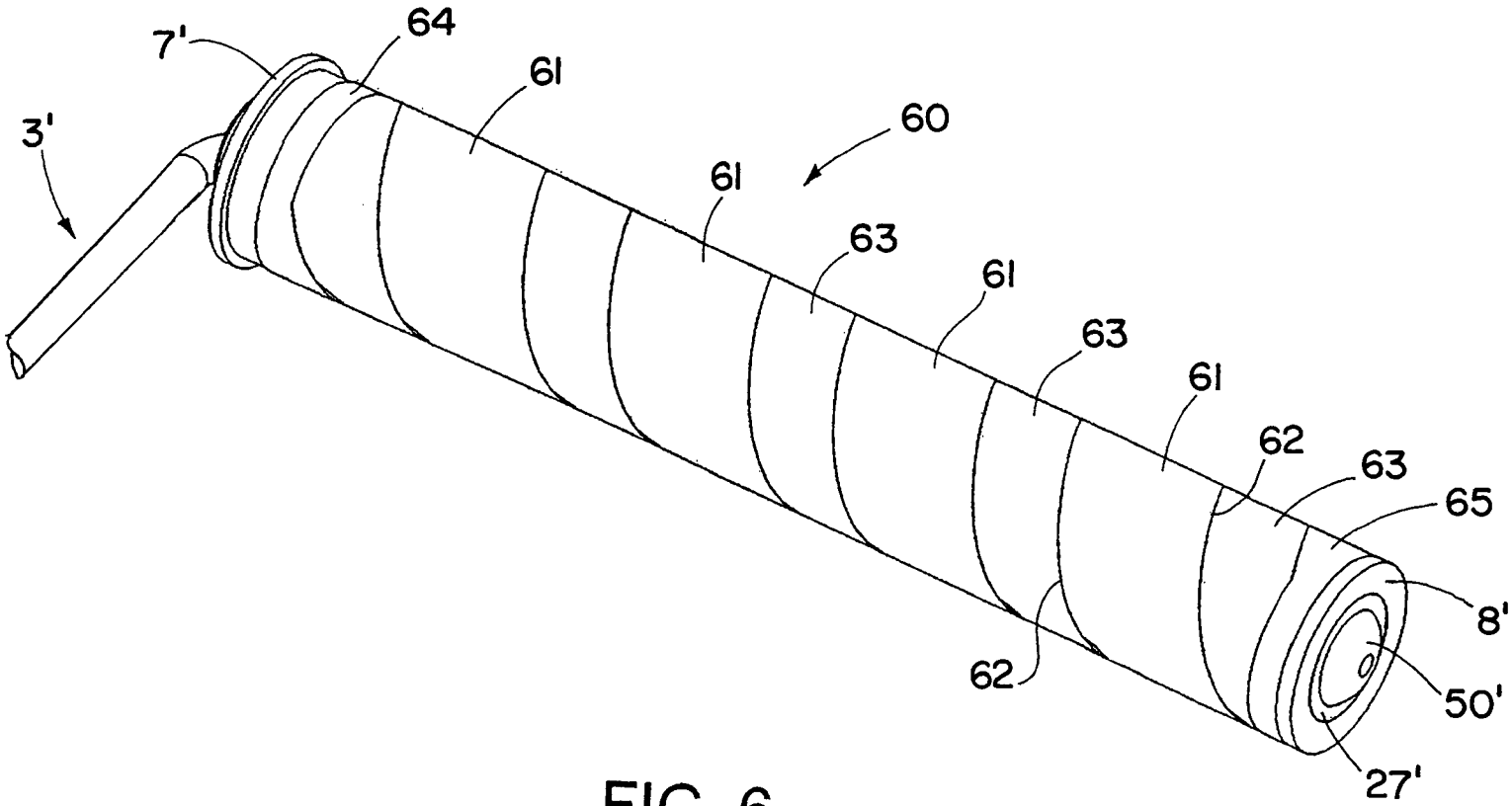
FIG. 6 is a schematic perspective view of another form of roller cover support of the present invention showing the elastomeric feature in its non-compressed condition to allow for easy insertion of a roller cover onto the support.
Figure 7:
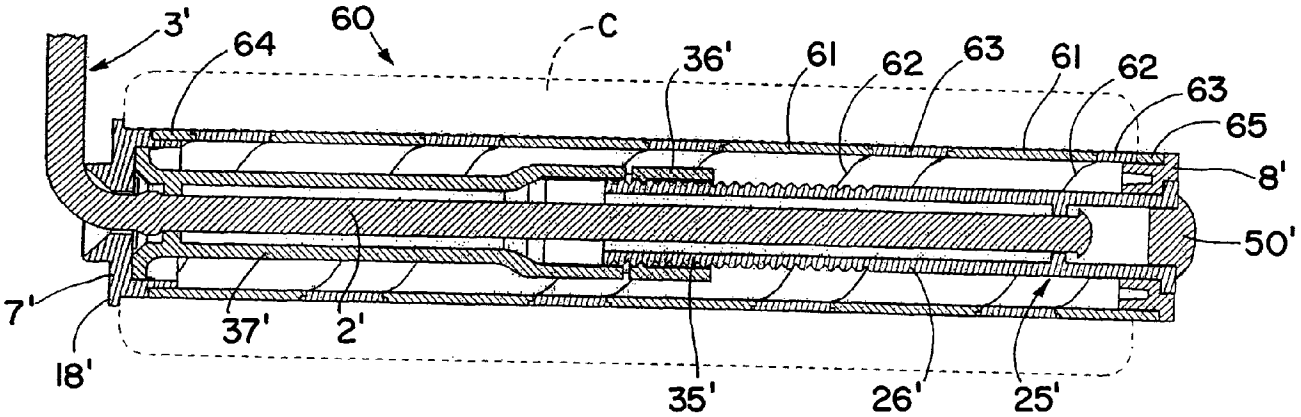
FIG. 7 is a longitudinal section through the roller cover support of FIG. 6 showing a roller cover slidably inserted onto the support.
Figure 8:
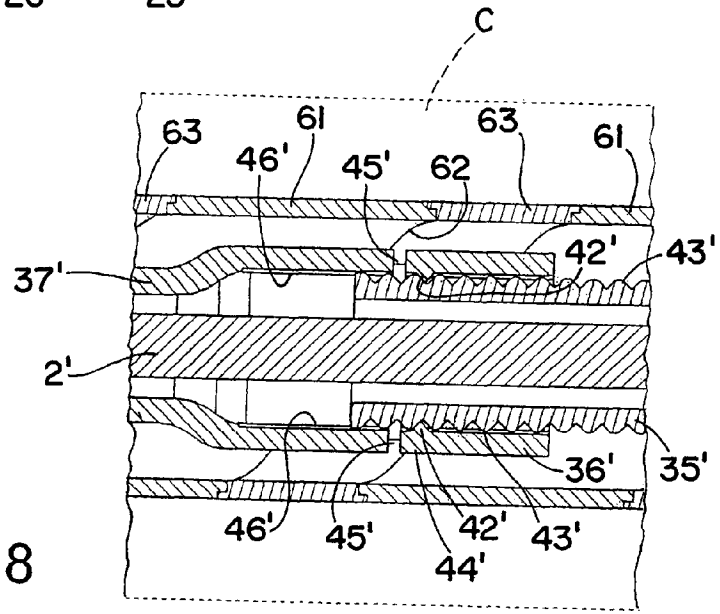
FIG. 8 is an enlarged fragmentary longitudinal section of a portion of the roller cover support of FIG. 7 showing the elastomeric feature in its non-compressed condition.

FIGS. 6-8 show the outboard end cap 8' fully extended without any compressive force being applied to the elastomeric material 63 in the groove 62 of the helix 61. In that state, the outer diameter of the elastomeric material 63, like the outer diameter of the helix, is slightly less than the inner diameter of the roller covers to be supported thereby for ease of sliding of the roller covers onto the roller cover support.

Figure 9:
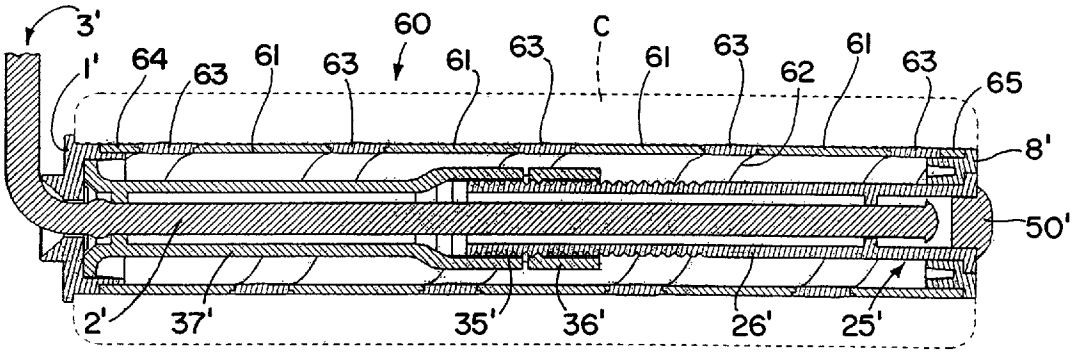
FIG. 9 is a longitudinal section through the roller cover support similar to FIG. 7 but showing the elastomeric feature in the compressed condition.
Figure 10:
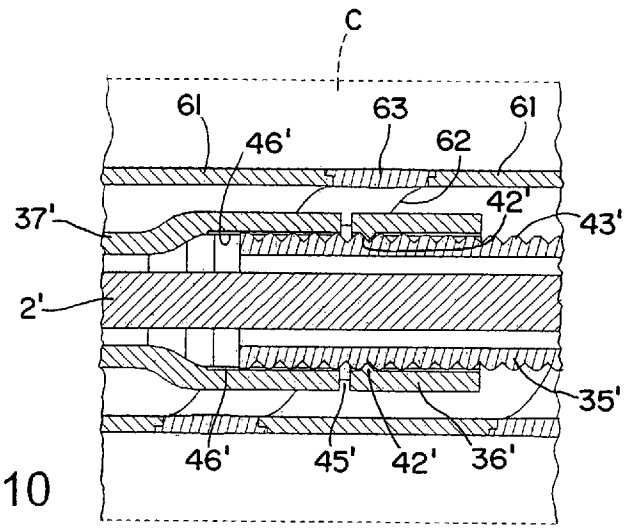
FIG. 10 is an enlarged fragmentary longitudinal section of a portion of the roller cover support of FIG. 9 showing the elastomeric feature in the compressed condition.

FIGS. 9 and 10 show the outboard end cap 8' and associated retainer 26' pushed axially inwardly toward the inboard end cap 7', thereby causing the substantially rigid helix 61 to compress the elastomeric material 63 in the helical groove 62 and expand the elastomeric material radially outwardly into frictional engagement with the inner diameter of the surrounding roller cover. Otherwise, the details of construction and operation of the roller cover support 60 shown in FIGS. 6-10 are substantially the same as the roller cover support 1 shown in FIGS. 1-5.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means" used to describe such components) are intended to correspond, unless otherwise indicated, to any component which performs the specified function of the described component (e.g., that is functionally equivalent), even though not structurally equivalent to the disclosed component which performs the function in the herein exemplary embodiments of the invention. In addition, while a particular feature of the invention may have been disclosed with respect to only one embodiment, such feature may be combined with one or more other features of other embodiments as may be desired and advantageous for any given or particular application.

What is claimed is:

1. A support for rotatably supporting a paint roller cover on a shaft portion of a roller frame, the support comprising axially spaced substantially rigid portions each having an outer diameter slightly less than an inner diameter of the roller cover when supported thereon, each of a plurality of the substantially rigid portions being axially movable toward and away from one another, and a plurality of elastomeric rings interposed between opposed ends of a plurality of the substantially rigid portions, each of the axially movable, substantially rigid portions when relatively axially moved toward one another, cause the elastomeric rings interposed therebetween to be compressed and expand radially outward into frictional engagement with the inner diameter of the surrounding roller cover for securely retaining the roller cover on the support.

2. The support of claim 1 wherein the plurality of axially spaced substantially rigid portions comprise substantially rigid plastic rings each having an outer diameter slightly less than the inner diameter of the roller cover when supported thereby.

3. The support of claim 2 wherein the elastomeric rings are over molded between opposed ends of a plurality of the substantially rigid rings.

4. The support of claim 2 wherein a plurality of the elastomeric rings and a plurality of the substantially rigid rings have opposed ends that are mechanically connected together.

5. The support of claim 2 wherein a plurality of the elastomeric rings and a plurality of the substantially rigid rings have opposed ends that are adhesively bonded together.

6. The support of claim 2 wherein opposed ends of a plurality of the elastomeric rings and a plurality of the substantially rigid rings have opposed ends that are plastic welded together.

7. A support for rotatably supporting a paint roller cover on a shaft portion of a roller frame, the support comprising axially spaced substantially rigid portions for supporting the roller cover thereon, each of a plurality of the substantially rigid portions being axially movable toward and away from one another, and elastomeric material interposed between opposed ends of a plurality of the substantially rigid portions that is compressed during axial movement of each of the axially movable, substantially rigid portions toward one another to cause the elastomeric material to expand radially outward into frictional engagement with an inner diameter of a surrounding roller cover for securely retaining the roller cover on the support, wherein inboard and outboard end caps are rotatably mounted on the shaft portion in axially spaced relation from one another, the substantially rigid portions are interposed between the inboard and outboard end caps, and the outboard end cap is axially movable toward and away from the inboard end cap for causing axial inward and outward movement of a plurality of the substantially rigid portions to compress and decompress the elastomeric material between the substantially rigid portions.

8. The support of claim 7 wherein a receiver is attached to the inboard end cap and extends axially outwardly along the shaft portion radially inwardly of the substantially rigid portions and the elastomeric material, and a retainer is attached to the outboard end cap and extends axially inwardly along the shaft portion radially inwardly of the substantially rigid portions and the elastomeric material, and wherein the receiver and the retainer have overlapping end portions, one of the end portions having axially spaced bumps or ribs on opposite sides of the one end portion, and the other end portion having teeth on opposite sides of the other end portion that ride in and out of the bumps or ribs on the one end portion during axial movement of the outboard end cap toward and away from the inboard end cap for releasably retaining the outboard end cap in different axial positions relative to the inboard end cap.

9. The support of claim 8 wherein the retainer and the receiver are keyed together for rotation as a unit on the shaft portion.

10. The support of claim 9 wherein the inboard end cap is rotatably supported on the shaft portion by an inboard bearing that is retained against axial movement along the shaft portion.

11. The support of claim 7 wherein the elastomeric material comprises a plurality of elastomeric rings interposed between a plurality of the substantially rigid rings, and the substantially rigid rings and the elastomeric rings collectively extend a length substantially corresponding to the axial space between the inboard and outboard end caps.

12. The support of claim 11 wherein adjacent ends of the respective inboard and outboard end caps, the substantially rigid rings and the elastomeric rings are interconnected together.

13. The support of claim 11 wherein the adjacent ends of the respective inboard and outboard end caps, the substantially rigid rings and the elastomeric rings have overlapping grooved edges that are interconnected together.

14. The support of claim 8 wherein the retainer end portion is axially slidably received in the receiver end portion, and the axially spaced bumps or ribs are on opposite radial outer sides of the retainer end portion and the teeth are on opposite radial inner sides of the receiver end portion.

15. The support of claim 14 wherein wall portions of the receiver end portion on which the teeth are formed are slotted partway around the teeth to facilitate flexing of the wall portions during riding of the teeth in and out of the bumps or ribs on the retainer end portion.

16. A support for rotatably supporting a paint roller cover on a shaft portion of a roller frame, the support comprising axially spaced substantially rigid rings each having an outer diameter slightly less than an inner diameter of the roller cover when supported thereon, each of a plurality of the substantially rigid rings being axially movable toward and away from one another, and a plurality of elastomeric rings interposed between opposed ends of a plurality of the substantially rigid rings, each of the axially movable substantially rigid rings when relatively axially moved toward one another, cause the elastomeric rings interposed therebetween to be compressed and expand radially outwardly into frictional engagement with the inner diameter of the surrounding roller cover for securely retaining the roller cover on the support.

17. The support of claim 16 wherein a plurality of the elastomeric rings and a plurality of the substantially rigid rings have opposed ends that are connected together.

* * * * *